United States Patent [19]

Sauer

[11] 4,357,955

[45] Nov. 9, 1982

[54] ELECTROHYDRAULIC CONTROL ARRANGEMENT

[75] Inventor: Ivan Sauer, Hausach, Fed. Rep. of Germany

[73] Assignee: Erwin Hengstler Hydraulik GmbH, Hausach, Fed. Rep. of Germany

[21] Appl. No.: 199,912

[22] Filed: Oct. 23, 1980

[30] Foreign Application Priority Data

Oct. 26, 1979 [DE] Fed. Rep. of Germany ..... 2943256

[51] Int. Cl.[3] ..... F15B 13/08

[52] U.S. Cl. ..... 137/270; 91/420; 137/491; 137/539.5; 137/596.12; 137/596.16; 137/596.2; 137/625.64; 251/129

[58] Field of Search ..... 91/420; 137/270, 491, 137/539.5, 596.12, 596.16, 596.2, 625.64; 251/129

[56] References Cited

U.S. PATENT DOCUMENTS

| | | | |
|---|---|---|---|
| 2,591,800 | 4/1952 | Gardiner | 137/625.64 X |
| 3,151,630 | 10/1964 | Tennis | 137/596.2 |
| 3,402,736 | 9/1968 | Trick | 137/596.12 |
| 3,416,561 | 12/1968 | Kokaly | 137/596.13 X |
| 3,677,287 | 7/1972 | Morris | 137/491 |
| 3,818,936 | 6/1974 | Jackoboice et al. | 137/596.12 |
| 3,827,255 | 8/1974 | Kish | 137/539.5 X |
| 4,121,610 | 10/1978 | Harms et al. | 137/596.12 X |
| 4,194,719 | 3/1980 | Ewald et al. | 137/625.64 X |

FOREIGN PATENT DOCUMENTS

| | | | |
|---|---|---|---|
| 1298801 | 7/1969 | Fed. Rep. of Germany | 137/115 |
| 2315424 | 10/1974 | Fed. Rep. of Germany | 251/129 |
| 1151483 | 1/1958 | France | 251/129 |
| 1487472 | 5/1967 | France | 137/625.64 |
| 380467 | 9/1964 | Switzerland | 137/625.64 |

*Primary Examiner*—Gerald A. Michalsky
*Attorney, Agent, or Firm*—Michael J. Striker

[57] ABSTRACT

An electrohydraulic control arrangement comprising at least one terminal plate having an inlet port connected to a pump pumping fluid under pressure from a tank and an outlet port connected to a return conduit leading to the tank and a plurality of consumer plates having consumer ports connected to consumers of pressure fluid. All plates are arranged side by side and held in abutting relationship by tightening screws extending through axially aligned bores through said plates. The plates are further provided with three axially aligned fluid channels therethrough, one to be connected to the inlet port and the two others to the outlet port. The selective connection of the fluid channels to the respective ports is accomplished in the terminal plate by a control slide movable by auxiliary valves, one of which is controlled by an electromagnet and by an additional control slide in each of the consumer plates, the position of which is controlled by two additional auxiliary valves. Each of the consumer plates includes two further auxiliary valves cooperating with a control piston in such a manner that when one of the consumer ports of the respective consumer plate is connected to the inlet port, the other is automatically connected to the outlet port.

41 Claims, 6 Drawing Figures

ELECTROHYDRAULIC CONTROL ARRANGEMENT

BACKGROUND OF THE INVENTION

The present invention relates to an electrohydraulic control arrangement comprising a plurality of electromagnetically controlled consumer plates and at least one terminal plate which may be provided with a pressure limiting valve for the pump and tank connection.

In a known control arrangement of the aforementioned type, the various consumer plates are mounted on a terminal plate in which the consumer ports are provided, whereas the common pump and tank connections are selectively provided on one of two end plates connected by screws to the consumer plates. The terminal plate is laid out for a predetermined number of consumer plates so that at an eventual necessary enlargement of the control arrangement a larger terminal plate has to be provided, if such a larger plate with a number of closed connections is not originally foreseen. In this known arrangement all connections are fixed and can hardly be varied.

SUMMARY OF THE INVENTION

It is an object of the present invention to improve a control arrangement of the abovementioned kind in such a manner that an enlargement or a change of the control arrangement may be carried out in a quick and efficient manner with small expenditure and that especially the direction of the various connections may be quickly adapted to different conditions.

With these and other objects in view, which will become apparent as the description proceeds, the electrohydraulic control arrangement according to the present invention mainly comprises at least one terminal plate having an inlet port connected to a source of pressure fluid and an outlet port connected to a return conduit leading to a tank, a plurality of consumer plates having ports connected to consumers, in which the plates are arranged side by side in abutting relationship and are each formed with a plurality of bores axially aligned with the bores in the other plates and with a plurality of fluid channels therethrough axially aligned with the fluid channels in the other plates, in which the fluid channels and the bores are respectively symmetrically arranged with respect to a plane of symmetry in the plates, and a plurality of tightening screws respectively extending through the aligned bores for holding the plates in tight abutting relationship.

Due to the symmetrical arrangement of the various bores and fluid channels with respect to a plane of symmetry it is possible to turn the individual plates according to requirements through 180°. Furthermore, if more plates are necessary for a specific arrangement, then it is possible in a simple manner, by use of longer tightening screws, to connect any necessary number of plates to each other. Since the fluid channels extend through all of the plates, special provision for the connection of additional plates are not necessary.

An especially advantageous arrangement is derived if the fluid channel, which is connected to the inlet port, is arranged in the aforementioned plane of symmetry and in which two fluid channels to be connected to the outlet port, respectively the return conduit, are arranged symmetrically with respect to the plane of symmetry.

It is also advantageous to provide the plates at the facing side faces thereof in the region of the bores and channels with abutment-, respectively sealing faces slightly projecting beyond the side faces, so that the plates will abut only at the abutment or sealing faces against each other while the remainder of the side faces will be spaced from each other, so that cooling air may pass between the side faces of the plates. In this way the control arrangement may be used for cooling the pressure medium passing therethrough.

Preferably each plate is provided with a bore therethrough substantially normal to the plane of symmetry and includes a spring-loaded control slide axially movable in this bore and a pair of closer screws closing opposite ends of the bore and forming at the same time stops for limiting axial movement of the control slide.

A relatively quiet and energy saving operation is obtained when the terminal plate includes further a first auxiliary valve, constituted by an adjustable overpressure valve, and a second auxiliary valve, constituted by a reversing valve movable between an open and a closed position, provided with an electromagnet for controlling the positions thereof, and cooperating with the control slide for controlling the axial movement of the latter. This construction requires relatively small space and only a few individual parts, so that this construction may be manufactured at reasonable cost. The overpressure valve limits the maximum pressure which can be applied to the consumers and the reversing valve directly connects the inlet port with the outlet port when none of the consumers is actuated. This arrangement will not only reduce the expenditure of energy, but the pressure medium will, due to the relatively small necessary throttling, be heated up to only a very small extent.

One end face of the control slide is preferably impinged by pressure fluid passing through the inlet port, whereas the other end face is connectable by the auxiliary valve to the fluid channel communicating with the outlet port. The connecting channels may in this case be constructed exceedingly short and in a manner causing low pressure losses.

The two auxiliary valves are spring-biased, one-way valves, preferably ball valves, which can be manufactured at reasonable cost. The pretension of the spring of the first auxiliary valve may be adjusted from the outside of this valve, to adjust thereby the maximum pressure of the fluid passing through the arrangement.

Advantageously one or both of the auxiliary valves comprise a tubular screw, easily exchangeably mounted in the plate and forming at one end of the tubular screw a valve seat. To avoid hard impacts during closing of the auxiliary valve, the valve body thereof, preferably a ball, is guided for movement in axial direction. During abutment of the valve body on the valve seat a damping of the engaging movement is then obtained by the pressure medium. Thereby the wear of valve seat and valve body, as well as the noise during closing of the valve is reduced.

In order not to overstress the springs, the stroke of the valve body away from its valve seat is limited by an abutment, whereby the radial guiding of the valve body is still available when the valve body reaches the abutment. The radial guiding is preferably formed by a cylindrical wall provided with radial slits. The radial slits may serve, on the one hand, to facilitate screwing of the valve seat into the tubular screw, and, on the other hand, for the through flow of the pressure medium.

The surface of the valve seat may be manufactured at very reasonable cost by a simple coining operation and subsequent hardening.

The valve seat can be held in a section at the end of the bores of the hollow screw simply by inwardly bending the outer end of the hollow screw. In order to avoid a detrimental influence of manufacturing tolerances and alignment errors on the function of the auxiliary valve, it is advantageous to provide an actuating pin for the valve body, which is axially guided in the valve seat. Thereby a canting or clamping of the valve body and the member for actuating the same is practically avoided. The length of the actuating pin is advantageously dimensioned in such a manner that, when the pin is fully depressed, the valve body will still be located slightly spaced from the abutment. Thereby the valve will be fully open while the spring biasing the valve body to its seat will not be overstressed.

Preferably the hollow screw is provided at the outer surface thereof with a sharp edge which sealingly engages a sealing face of the plate, and the edge is constructed harder than the sealing face so that sealing rings or other sealing means can be avoided.

The control slide of the terminal plate is formed with a passage therethrough, extending between opposite end faces of the slide, and at least one throttle is arranged in this passage. By means of this control slide the fluid channels communicating with the inlet port and the fluid channels communicating with the outlet port may be connected to each other or separated from each other and a pre-throttle is advantageously provided for initiating such connection. The pre-throttle is formed by a cross bore of small-cross section in the control slide in order to initiate the switching operation performed by the same with the least possible noise.

To reduce the danger of an accident during loss of pressure, it is advantageous to connect the opposite end faces of the control slide in each consumer plate, which is movable by hydraulic pressure, over releasable opposite one-way valves respectively with one or the other consumer port of this plate, whereby alternatively one of the one-way valves will be opened by the pressure of the hydraulic fluid and the other by means of a control piston acting on an actuating pin.

To obtain short connecting channels, the opposite end faces of the control slide, movable by hydraulic pressure in each of the consumer plates, are respectively connected by throttles to the fluid channel which is to be connected to the inlet port and the two opposite end faces are respectively connectable by means of controllable one-way valves with the return conduit. The two one-way valves, in turn, are movable to an open position against the action of springs by electromagnets. The control slide of each consumer plate is biased by two opposite compression springs to a neutral middle position, whereby the springs are arranged so that the action thereof will actually urge the control slide to this middle position.

To obtain this result the control slide is formed with a pair of axially spaced bores extending from opposite end faces thereof into the latter, in which a pair of bushings are respectively slidably arranged for respectively receiving one of the ends of the compression springs and the bushing in each of the bores has at its outer end a flange radially projecting beyond the end face of the control slide to engage in the neutral position of the latter a face portion of the plate surrounding the aforementioned bore. During movement of the control slide away from its neutral position the inner end of one of the bushings against which one end of the respective compression spring abuts will be disengaged from the inner end of the respective bore, whereas the flange of the other bushing will abut during the maximum stroke of the control slide against the inner end of a closer screw closing the opposite ends of the bore in which the control slide is movable.

To minimize the danger of fouling the control slide by impurities contained in the pressure fluid passing therethrough, the two opposite throttles in the central passage through the control slide are connected by at least one transverse passage with a central annular groove in the outer surface of the control slide and an annular sieve is located in this groove to thus prevent impurities passing into the interior of the control slide to foul the throttles. Tests have shown that the control slide is slowly rotated by the hydraulic fluid which enhances cleaning of the annular sieve.

Five annular channels are provided about the bore in which the control slide is movable and these channels are arranged symmetrically to the plane of symmetry, whereby the two outer annular channels or compartments are connectable to the fluid channels connectable to the outlet port, whereas the middle annular channel is connected to the fluid channel communicating with the inlet port, and the two intermediate annular channels are connected over hydraulically openable one-way valves with the two consumer ports provided in each consumer plate. The control slide is formed at the outer periphery thereof with two axially spaced annular grooves, which in the neutral position of the control slide block passage of fluid to and from the consumer ports and which in the end positions of the control slide permit flow of pressure fluid to one of the consumer ports and discharge of pressure fluid from the other of the consumer ports to the tank. The annular channels may be formed by casting of the plates so that only the bore receiving the control slide has to be machined.

The two abovementioned one-way valves are arranged symmetrically with respect to the plane of symmetry in a stepped bore and are separated from each other by a control piston arranged to open one or the other one-way valve during the movement thereof, whereby the opposite end faces of the control piston are adapted to be impinged by the fluid passing to the consumer ports.

Each of the aforementioned one-way valves comprises a spring-biased valve member, preferably a ball, which is guided by axial guide faces towards a valve seat formed in a carrier for an axially movable actuating pin, to be engaged by the aforementioned control piston for moving the respective one-way valve to the open position. Due to the axial guiding of the valve member the latter will exactly and dampened by the fluid medium abut against its valve seat, so that wear of the valve member will be very small.

In order to avoid an exact machining of the stepped bore in which the two one-way valves are arranged while assuring a tight seat of the latter in the stepped bore, each of the one-way valves has a hard sealing surface cooperating with a softer sealing edge of the stepped bore, so that special additional seals are not necessary.

The opposite ends of the aforementioned stepped bore are closed by closer screws, which respectively form also abutments for the springs of the corresponding one-way valves and which also limit the stroke of the valve body in opening direction so as to avoid excessive compression of these valve springs.

In order to assure that during actuating of one of the consumers the required fluid pressure is available, the terminals of the magnets in all consumer plates are respectively connected through at least one diode with the terminal of the magnet at the terminal plate.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
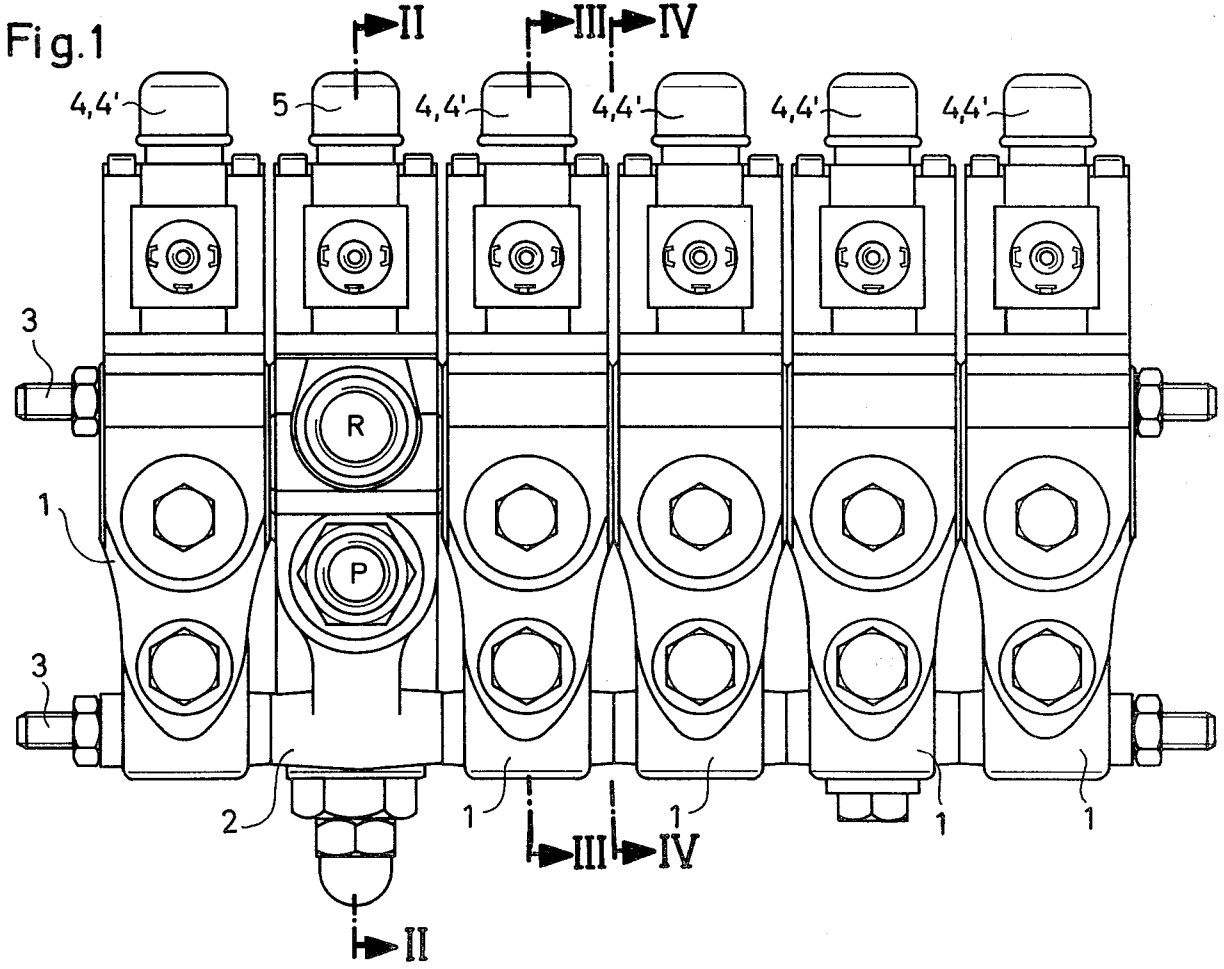
FIG. 1 is a side view of the electrohydraulic control arrangement according to the present invention with a single terminal plate and five consumer plates connected together to a unit.
Figure 2:
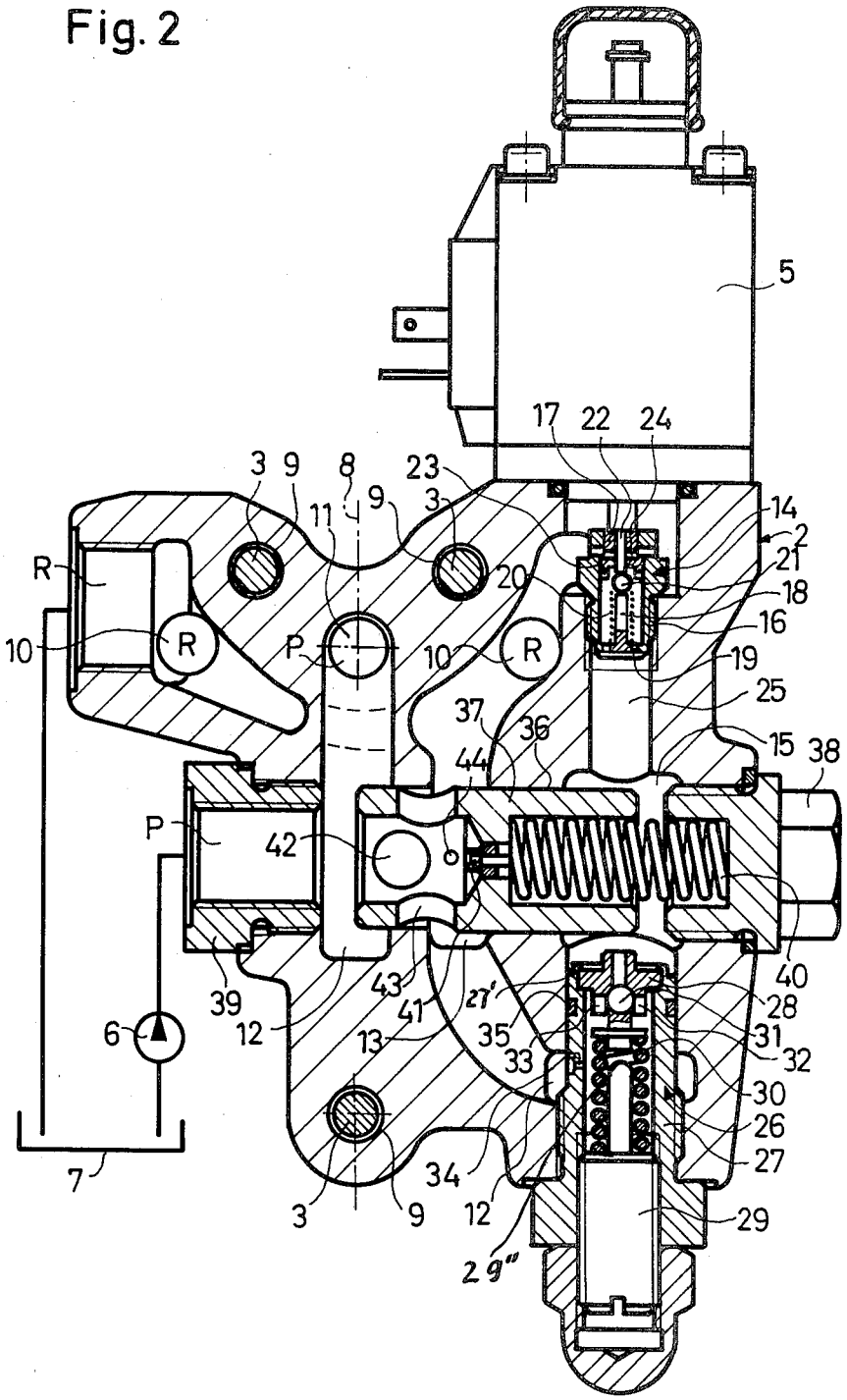
FIG. 2 is a cross-section taken along the line II—II of FIG. 1 through the terminal plate.
Figure 3:
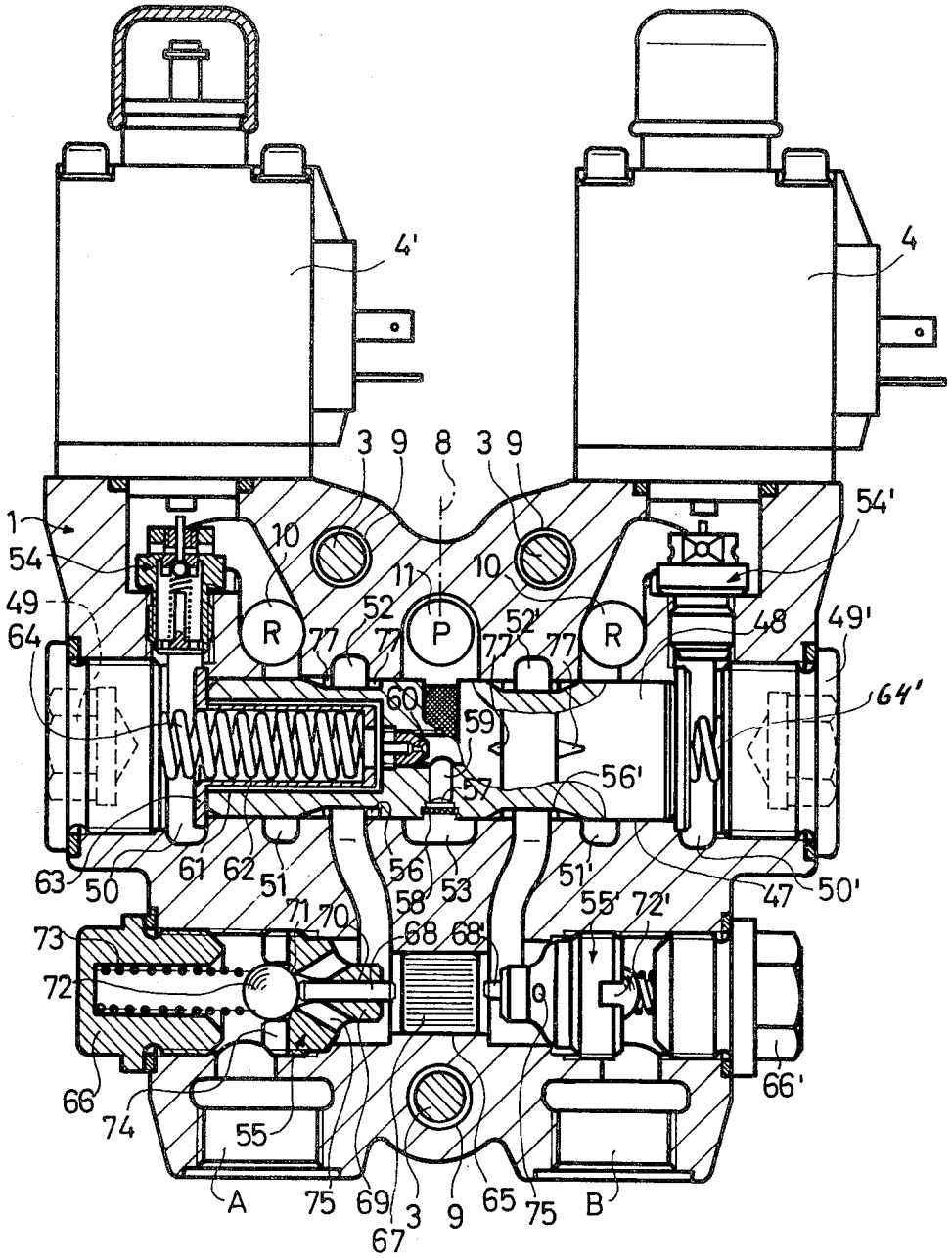
FIG. 3 is a cross-section taken along the line III—III of FIG. 1 through one of the consumer plates.

The electrohydraulic control arrangement according to the present invention comprises, as shown in FIG. 1, five practically identically constructed consumer plates 1 and a terminal plate 2 arranged side by side and held in abutting relationship by three tightening screws 3. As shown in FIGS. 2 and 3 two electromagnets 4, 4' are mounted on each consumer plate 1 and an electromagnet 5 is mounted on the terminal plate 2, which electromagnets are connected by wires and switches, not shown in the drawing, to a supply of electric energy. The terminals of the electromagnets 4 and 4' of the consumer plates 4 are respectively connected by at least one diode D to the terminal of the electromagnet 5 on the terminal plate 2.

As shown in FIG. 2, the terminal plate 2 has an inlet port P connected to a source of hydraulic fluid under pressure, for instance a pump 6, and an outlet or return port R which is connected to a tank 7 from which the pump 6 pumps the fluid.

The tightening screws 3 pass through aligned bores 9 formed through all of the plates, symmetrically with respect to a plane of symmetry 8, whereby the lowermost of the bores 9 is arranged in the aforementioned plane of symmetry, whereas the upper two bores 9 are arranged equally spaced from opposite sides of this plane. All of the plates are further provided with three fluid channels 10 and 11, whereby the fluid channel 11 is located in the symmetry plane and the two other fluid channels 10 are arranged symmetrically spaced therefrom. The fluid channel 11 in the terminal plate 2 is connected with the inlet port P, whereas the fluid channels 10 are connected to each other and with the return port or outlet port R and also connectable with an annular channel 12 and a further annular channel 13. The return passage R is also connected to an auxiliary valve 14, actuatable by the electromagnet 5. The auxiliary valve 14, which is arranged between the electromagnet 5 and an additional annular channel 15 comprises a hollow screw 16, into the upper end of which a valve seat 17 is screwed, whereas at the opposite end a spring carrier 18 is held by bent over portions of the hollow screw. The spring carrier 18 is mushroom-shaped and is provided at its lower end with a plurality of openings 19, whereas the central stem of the spring carrier guides the spring 20 and serves at the same time as abutment for the valve body 21, in the form of a ball, to limit movement of the valve body away from the valve seat.

The valve seat 17 is provided with a stepped bore, in the larger diameter portion of which the ball-shaped valve member 21 is axially guided, whereas in the small diameter portion of which an actuating pin 22 is guided for movement in axial direction. The actuating pin 22 is movable by the electromagnet 5 against the valve body 21. The length of the actuating pin 22 is dimensioned in such a manner so that when the actuating rod of the magnet 5 abuts against the valve seat, the valve body will not abut against the end of the stem of the spring carrier 18 which limits the stroke of the valve body 21 away from its valve seat. The hollow screw 16 is provided in the region of its upper end with a plurality of radial slots 23 which serve in connection with the cross bores 24 through the valve seat 17 not only for the flow of pressure medium into the interior of the valve seat, but which may also serve for engagement with a tool for screwing the hollow screw 16 into the bore provided in the plate.

The auxiliary valve 14 is arranged in a stepped bore 25 of the terminal plate 2 which passes also through the annular channel 15. A first auxiliary valve 26 is screwed into the lower end of the bore 25. The auxiliary valve 26 comprises also a hollow screw 27, a valve seat 28 at the upper end of the hollow screw and held thereon by inwardly bent portion of the latter, whereas a set or adjusting screw 29 is screwed into the opposite end of the hollow screw 27 which serves to adjust the pretension of the spring 30 which biases the ball-shaped valve body 31 against the valve seat. The set screw 29 is locked by and its outer end is sealed by a cap screw 29'.

The ball-shaped valve member 31 of the first auxiliary valve 26 is carried by a spring guide 30' and is guided for movement in axial direction and the radial guiding 32 of the valve body 31 is formed by a cylindrical wall in which a plurality of radial slits 33 are provided.

The adjusting screw 29 has at its inner end a coaxial reduced diameter position 29'' projecting towards the valve member 31. The spring 30 abuts with one end against the screw 29 and with the other end against the spring guide 30'. The free end of the reduced diameter portion 29'' of the screw 29 forms an abutment for limiting movement of the spring guide 30' away from the valve seat.

The hollow screw 27 has a sealing edge 27' pressed against a sealing face 2' and having a greater hardness than the sealing face. The interior of the hollow screw 27 is connected by a connecting channel 34 with the annular channel 12 and sealed by a sealing ring 35 toward the annular channel 15.

A control slide 37 is guided for movement in axial direction in a bore 36 extending normal to the plane of symmetry 8 through the terminal plate 2, by means of which the annular channels 12 and 13 may be connected or separated from each other. A pair of closer screws 38 and 39 are screwed into opposite ends of the bore 36 for the control slide 37 and the closer screws serve at the same time to limit axial movement of the control slide 37 in either direction away from the position as shown in FIG. 2. The closer screw 38 is formed with a central cavity and the facing end of the control slide 37 is formed with a corresponding cavity for a compression-spring 40. A stepped bore extends from the inner end of the cavity formed in the control slide 37 to the opposite end face thereof and a throttle 41 which may be constituted by a commercially available carburetor nozzle is arranged in the small-diameter portion of this bore.

The control slide 37 is provided in the region of the end thereof facing the screw 39 with two cross bores 42 and 43 which are arranged in such a manner to connect in the neutral position of the control slide 37, as shown in FIG. 2, the channels 12 and 13 with each other and to separate these channels from each other when the control slide 37 is moved into abutment with the screw 39. A throttle opening 44, in form of a cross bore of small diameter, is also provided parallel to the cross bore 42 through the control slide 37, by means of which a softer actuation of the control slide is obtained. The screw 39 is formed with an opening therethrough which constitutes the aforementioned inlet port P which is connected to the pump 6.

Figure 5A:
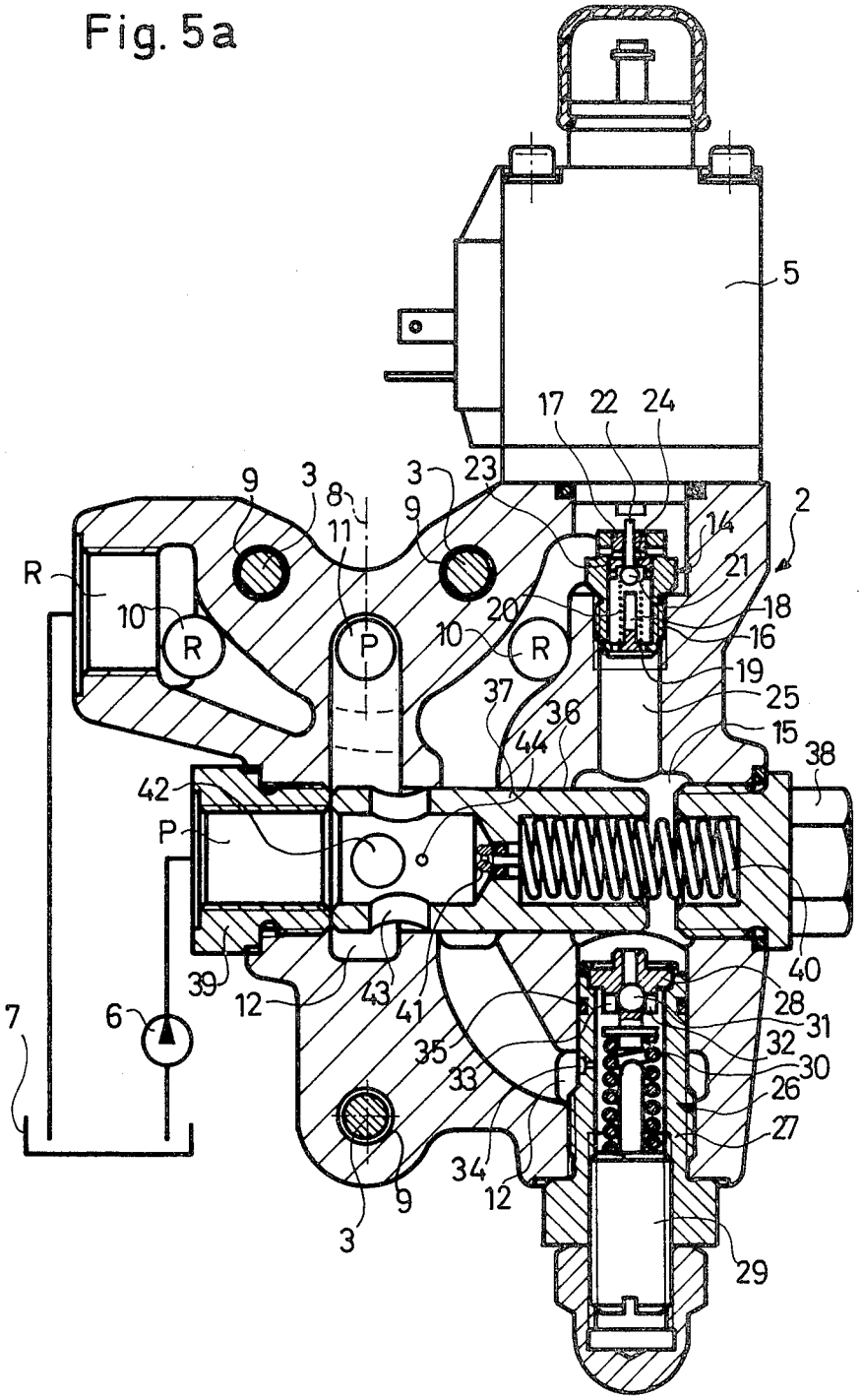
FIGS. 5*a* and 5*b* respectively correspond to FIGS. 2 and 3, but showing the various elements of the respective plates in different positions.

The terminal plate 2 above described will operate as follows:

In the neutral position of the control slide 37, as shown in FIG. 2, pressure oil can flow from the inlet port P to the return connection R when the second auxiliary valve 14 is opened by the electromagnet 5 so that the annular channel 15 is pressureless. The pressure medium can therefore flow, without any essential throttling, from the pump 6 back to the tank 7. If now, as illustrated in FIG. 5*a*, the second auxiliary valve 14 is closed, the pressure in the annular channel 15 will increase and the control slide 37 will be moved towards the left, as viewed in FIG. 5*a*, so that pressure fluid will flow over the cross bores 42 and 43 to the channel 11. If only a small amount of pressure fluid will be taken in any of the consumer plates, pressure fluid will flow through throttle 41 so that the pressure in the annular channel 15 will further increase until finally the first auxiliary valve 26 will open and the pressure medium will flow through the cross bores 34 to the return passage R. Thereby the control slide 37 will move towards the right, as viewed in FIG. 5*a*, so that the pressure medium may flow to the return conduit R. The pressure at which the first auxiliary valve 26 opens can be adjusted by adjusting the pretension of the spring 30 thereof. The first auxiliary valve 26 regulates therefore the working pressure of the arrangement, whereas by the second auxiliary valve 14, when opened by the electromagnet 5, a pressure decrease may be accomplished if no pressure medium is used in any of the consumer plates to thereby save energy and prevent an unnecessary heating up of the pressure medium through throttling.

Figure 4:
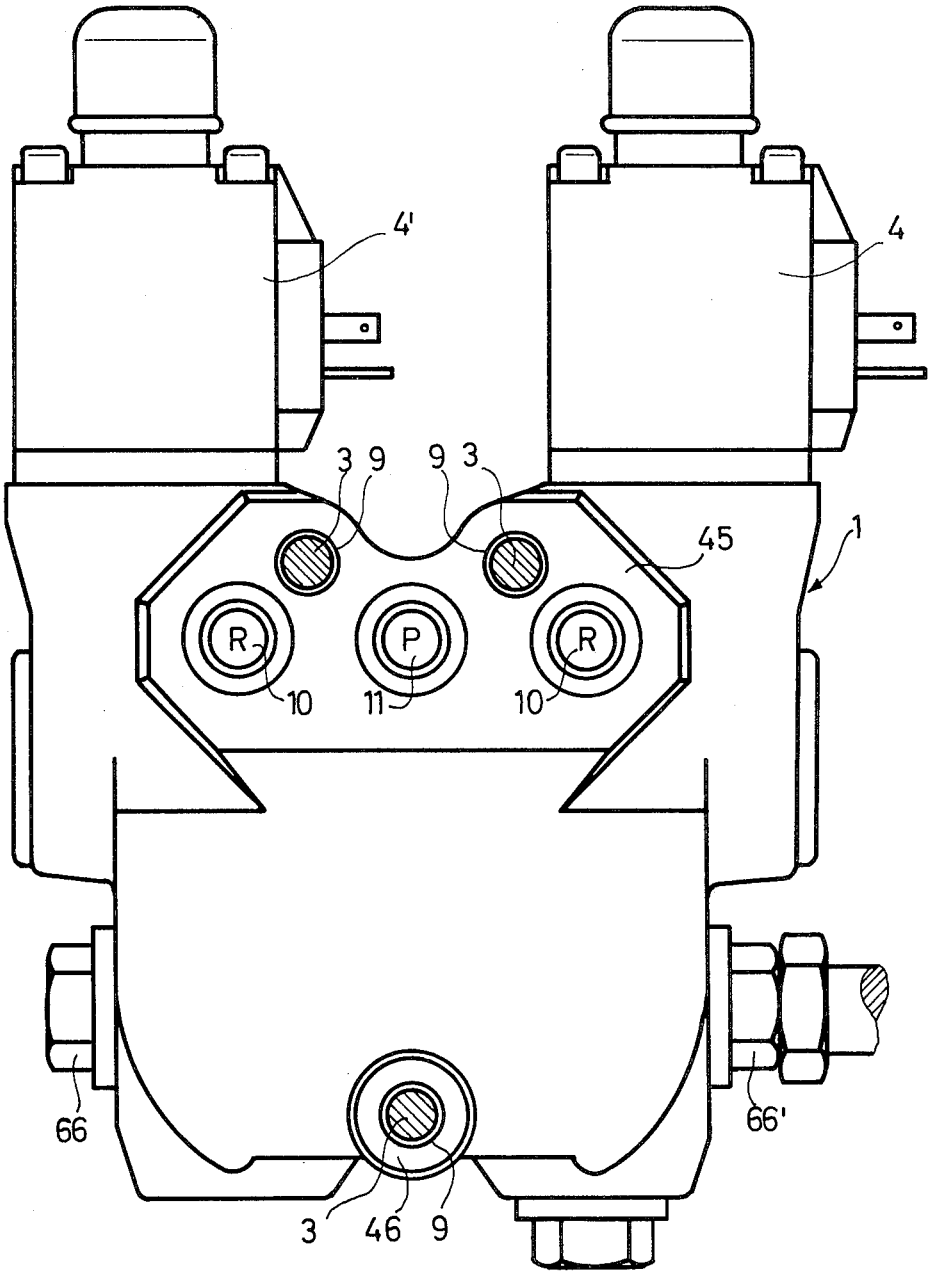
FIG. 4 is a cross-section taken along the line IV—IV of FIG. 1 and showing a side view of one of the consumer plates.

In order to dissipate any heat created in the pressure medium, the abutting sealing and abutting faces 45, respectively 46 (FIG. 4) are limited to the regions about the bores 9 and the channels 10 and 11 so that air for cooling may pass between the individual plates 1 and 2.

Due to the symmetrical arrangement of the fluid channels 10 and 11 and the bores 9 with respect to the plane of symmetry 8, it is possible to turn the consumer plates 1 as well as the terminal plate 2 through 180° in accordance with the consumer fluid connections.

As shown in FIG. 3 all of the consumer plates 2 are, as far as the arrangement of the bores 9 and the fluid channels 10 and 11 is concerned, constructed in the same way as the terminal plate so that the bores 9 and the channels 10 and 11 will be aligned in the plates 1 and 2 when the same are held in abutting relationship by the tightening screw 3.

Each of the consumer plates 1 is also provided with a bore 47 therethrough, normal to the plane of symmetry 8, in which a control slide 48 is axially movable. The bore 47 is closed at opposite ends by closer screws 49 and 49' which serve at the same time as abutments for the control slide 48. Seven annular channels 50, 50', 51, 51', 52, 52' and 53 are arranged in each of the consumer plates 1, symmetrically to the plane of symmetry 8, about the bore 47. The central annular channel 53 communicates with the fluid channel 11, the annular channels 51 and 51' communicate with the fluid channels 10 and the annular channels or compartments 50 and 50' can be connected over the one-way valves 54 and 54' likewise with the fluid channels 10, whereas the two annular channels 52 and 52' can be connected respectively by the one-way valve 55 and 55' with the consumer port A, respectively B.

The control slide 48 is provided at its outer pheripheral surface with three symmetrically arranged annular grooves 56, 56' and 57 and an annular sieve 58 is arranged in the central groove 57. The sieve 58 will prevent entrance of impurities contained in the pressure fluid into cross bores 59 communicating with the central groove 57. The cross bores 59 are connected over the throttles 60 and 60' with the end faces of the control slide 48. The throttles 60 and 60' are preferably constituted by carburetor nozzles commercially available.

A pair of large-diameter bores 61, 61' respectively extends from opposite ends of the control slide 48 into the latter and communicate with the throttles 60 and 60'. A pair of bushings 62, 62' are arranged in the bores 61, 61' and the bushings have at the outer ends thereof radially extending flanges 63, 63' which, in the neutral position of the control slide 48, abut against surface portion surrounding the outer ends of the bores 61 and 61'. A pair of compression spring 64 and 64' are respective located in the bushings 62 and 62' to abut with the outer ends thereof respectively against the close screws 49 and 49' for normally holding the control slide 48 in its neutral position as shown in FIG. 3. The length of the bushings 62 and 62' is dimensioned in such a manner that in the neutral position, as shown in FIG. 3, the inner end of each bushing is still slightly spaced from inner ends of the bores 61 and 61', so that the control slide 48 may be turned by the pressure medium flowing through the channel 11 to clean the sieve 48.

The one-way valves 54 and 54', controlled by the electromagnets 4 and 4', are in their construction identical with the second auxiliary valve 14 in the terminal plate 2 so that a further description of these valves seems unnecessary. Each of the valves 54 and 54' has a sealing edge 54'' which is harder than the face portion of the plate engaged by the same so that these valves are fluid tightly screwed in the corresponding consumer plate 1 without any further sealing means.

The one-way valves 55 and 55' are arranged in a stepped bore 65, extending parallel to the axis of the control slide 48 through each of the consumer plates 1.

The outer ends of the stepped bore 65 are closed by closure screws 66 and 66', whereas a control piston 67 is axially movable in the central smaller-diameter portion of the stepped bores 65 through which the one-way valves 55 and 55' are respectively actuatable over actuating pins 68 and 68'.

The one-way valves 55 and 55' are of identical construction and comprise each a carrier 69 provided with a stepped bore 70 in the smaller-diameter portion of which the actuating pin 68 respectively 68' is guided for movement in axial direction, whereas the large-diameter portion of the bore forms a valve seat 71 for a ball-shaped valve member 72, respectively 72', which is pressed by a spring 73 against the respective valve seat 71.

The ball-shaped valve members 72 and 72' are guided for movement in axial direction by the inner surface of the bore 70 and the pressure medium can flow laterally out over radial slots 74 communicating with the bore. The slots 74 serve at the same time for engagement with a tool for screwing the valves 55 and 55' into correspondingly threaded portions of the stepped bore 65. The pressure medium will flow through the carrier 69 through inclined connecting channels 75 extending inwardly from a frustoconical outer face 69' of the carrier. Each face 69' forms a sealing face cooperating with a sealing edge 65' in the bore 65, which sealing edge is softer than the sealing surface it engages.

The valve seat 71 is formed by embossing with a ball without any further mechanical treatment with the exception of a surface hardening. The axial guiding of the ball 72 will result in a dampened abutment of the latter on the valve seat 71 due to the displacement of the left pressure fluid rest before the abutment of the ball against the valve seat 71, whereby wear is avoided and the noise is reduced to a minimum.

In the neutral position, as shown in FIG. 3, the two one-way valves 55 and 55' are closed so that pressure medium will not flow to either of the ports A or B or flow back through one of the ports to the tank. The one-way valves 54 and 54' are likewise closed so that the control slide 48 is held in its neutral middle position by the prestressed compression springs 64.

Figure 5B:
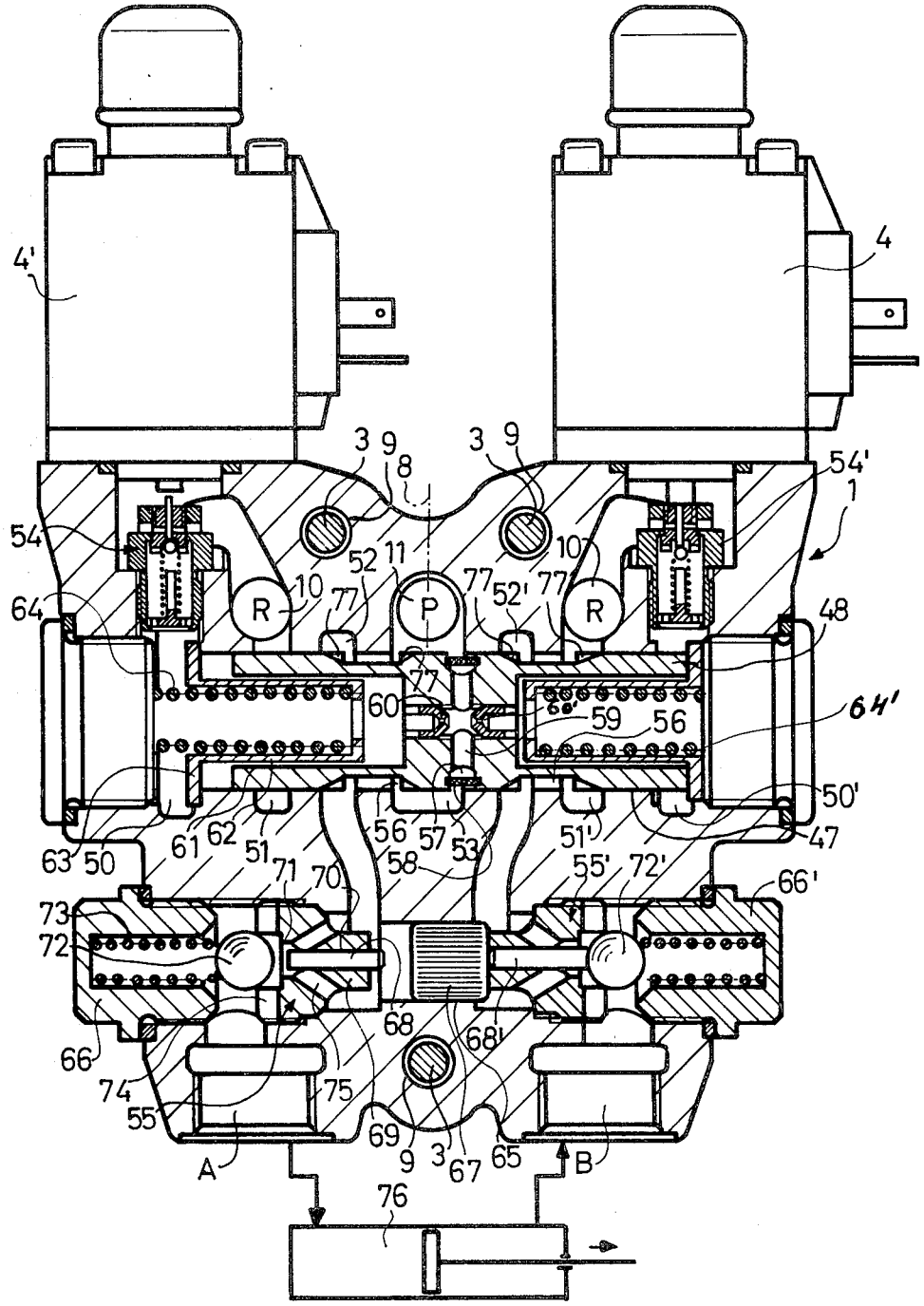

If now, as shown in FIG. 5*b*, for instance the electromagnet 4 is energized to open the one-way valve 54' pressure fluid may flow from the annular channel or compartment 50' over the opened one-way valve 54' to the fluid channel 10, which is pressureless or under very small pressure. Thereby the control slide 48 is moved towards the right as shown in FIG. 5*b*, by the pressure fluid passing through the fluid channel 11 over the cross bores 59 and the throttle 60 to the annular channel or compartment 50. This movement of the control slide 48 will connect the annular channels 52 and 53 as well as the annular channels 52' and 51' with each other, whereby, due to the increasing pressure in the annular channels 52, the ball 72 of the one-way valve 55 will be moved away from its valve seat so that the pressure medium will flow through to the port A. The pressure of the hydraulic fluid passing from the annular channel 52 to the port A will move the control piston 67 towards the right, whereby the actuating pin 68' is likewise moved towards the right, to move the ball 72' of the one-way valve 55' away from its valve seat so that pressure medium may flow over the port B, the annular channels 52' and 51' to the right fluid channel 10. If now the electromagnet 4 is deenergized, pressure will increase again in the annular channel 50' and the control slide 48 will again move to its neutral position as shown in FIG. 3, so that the one-way valve 55 and 55' will close, whereby flow of pressure fluid through the ports A and B is prevented. If the electromagnet 4' is energized instead of the magnet 4, it will be evident that pressure fluid will flow through the port B into the consumer 76 schematically shown in FIG. 5*b* and flow out from the left side of this consumer through the port A.

By closing one or the other port A and B and by arrangement of corresponding closer screws 66, respectively 66' with a port at the outer end thereof, the connection may be varied according to the requirements and it is possible also to reverse each of the consumer plates 1° through 180° without changing thereby the function of the control arrangement.

In order to prevent creeping of the piston in the consumer cylinder 76 schematically illustrated in FIG. 5*b* during occurrence of some leakage streams, there are provided at each of the annular grooves 56 and 56' at the outer surface of the control slide 48 some notches or inclined surface portions 77 through which also at a minor stopping of the control slide the desired switching function produced by the latter is assured.

By closing one or the other port A or B, each consumer plate 1 can also be used for a consumer which is to be impinged only at one side thereof by pressure fluid.

The electrohydraulic control arrangement according to the present invention has many uses and is especially used in construction machines, transport vehicles, especially fork lifts and the like.

It will be understood that each of the elements described above, or two or more together, may also find a useful application in other types of electrohydraulic control arrangements differing from the types described above.

While the invention has been illustrated and described as embodied in an electrohydraulic control arrangement including a terminal plate and a plurality of consumer plates connected in aligned side-by-side arrangement by a plurality of tightening screws, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constituted essential characteristics of the generic or specific aspects of this invention.

What is claimed as new and desired to be protected by Letters Patent is set forth in the appended claims:

1. An electrohydraulic control arrangement, comprising at least one terminal plate having an inlet port connected to a source of pressure fluid and an outlet port connected to a return conduit leading to a tank; a plurality of consumer plates fluid, said plates being arranged side by side in abutting relationship and being each formed with a plurality of bores axially aligned with the bores in the other plates and with a plurality of fluid channels therethrough axially aligned with the fluid channels in the other plates, said fluid channels being respectively adapted to communicate in said terminal plate with said inlet, respectively, said outlet port and in the consumer plate with said consumer ports, said fluid channels and said bores being respectively symmetrically arranged with respect to a plane of symmetry in said plates; and a plurality of tightening screws respectively extending through said aligned bores for holding said plates in tight abutting relationship, each of said plates being provided with a bore therethrough substantially normal to said plane of symmetry and including a spring-loaded control slide means axially movably guided in said bore between two end positions and a pair of closure screws at opposite ends of the bore and forming stops for limiting axial movement of the control slide means, said control slide means in each of said plates having a pair of opposite end faces and being formed with axial passage extending from one to the other of said end faces, the control slide means of each said consumer plate further having a transverse passage providing communication between the axial passage of the control slide means of the respective consumer plate and that fluid channel which communicates with said inlet port, the control slide means of the terminal plate having in the region of one end face thereof a transverse bore communicating with the axial passage of the control slide means of the terminal plate, and said terminal plate being formed with passage means forming in one end position of said control slide means of the terminal plate a connection between said inlet port and said transverse bore and in the other end position of said control slide means of the terminal plate a connection between said inlet port and a fluid channel connectable in each said consumer plate to the consumer outlet, and throttle means in said control slide of the terminal plate for establishing the connection prior to the establishing thereof by said transverse bore.

2. An electrohydraulic control arrangement as defined in claim 1, wherein three fluid channels are provided through each of said plates, one of said fluid channels adapted to communicate with the source of pressure fluid being located in said plane of symmetry and the other two fluid channels adapted to communicate with said return conduit being arranged on opposite sides and symmetrically with respect to said plane of symmetry.

3. An electrohydraulic control arrangement as defined in claim 2, wherein said plates are provided at facing side faces thereof in the region around the ends of said bores and said channels with abutment-, respectively sealing faces slightly projecting beyond said side faces so that the plates will abut only at said abutment-, respectively sealing faces against each other.

4. An electrohydraulic control arrangement as defined in claim 3, wherein three bores are provided through each of the plates, wherein the ends of the three fluid channels and the ends of two of the bores at each side face are located in the region of one sealing face and the end of the third bore at each side face is surrounded by an abutment face spaced from said one sealing face.

5. An electrohydraulic control arrangement as defined in claim 4, wherein said two bores are respectively arranged between said one fluid channel and the other two fluid channels.

6. An electrohydraulic control arrangement as defined in claim 1, wherein said terminal plate further comprises first auxiliary valve means constituted by an adjustable overpressure valve, second auxiliary valve means constituted by reversing valve means movable between an open and a closed position, and an electromagnet cooperating with said reversing valve for controlling the positions thereof, said first and said second auxiliary valve means cooperating with said control slide means of the terminal plate for controlling axial movement thereof.

7. An electrohydraulic control arrangement as defined in claim 6, wherein said control slide means of the terminal plate has a pair of opposite end faces, one of which is adapted to be impinged by pressure fluid passing through said inlet port and the other of which is connectable by said auxiliary valve means to the fluid channel communicating with the outlet port.

8. An electrohydraulic control arrangement as defined in claim 6, wherein both of said auxiliary valve means are spring-biased one-way valves.

9. An electrohydraulic control arrangement as defined in claim 8, wherein each of said auxiliary valve means comprises a spherical valve member and a spring pressing the valve member against a valve seat.

10. An electrohydraulic control arrangement as defined in claim 8, wherein said first auxiliary valve means includes means accessible from the outside of the terminal plate for adjusting the pressure of the spring pressing the valve member thereof against its valve seat.

11. An electrohydraulic control arrangement as defined in claim 10, wherein each of said auxiliary valve means comprises a tubular screw easily exchangeably mounted in the terminal plate and a valve seat at one end of the tubular screw.

12. An electrohydraulic control arrangement as defined in claim 11, including means guiding said spherical valve member for movement in axial direction of said tubular screw.

13. An electrohydraulic control arrangement as defined in claim 12, including stop means for limiting movement of said valve member away from said valve seat, said guide means being arranged to guide said valve member up to its movement against said stop means.

14. An electrohydraulic control arrangement as defined in claim 12, wherein said guide means is constituted by a cylindrical wall formed with radially extending slots therethrough.

15. An electrohydraulic control arrangement as defined in claim 11, wherein said tubular screw of one of the auxiliary valve means in said terminal plate comprises at the other end thereof a surface for engagement with a tool for turning said tubular screw about its axis and adjacent to said surface an outer screw thread for threadedly connecting said tubular screw to a threaded bore in said terminal plate, and including a seal in an annular groove in the outer surface of the tubular screw adjacent said one end of the latter, said terminal plate including an annular channel communicating with said outlet port and said tubular screw being provided between said annular seal and the adjacent end of said outer screw thread with a passage providing communication between the interior of said tubular screw and said annular channel.

16. An electrohydraulic control arrangement as defined in claim 15, wherein said one auxiliary valve means comprises an adjusting screw threadedly connected to said tubular screw and having at its inner end a coaxially reduced diameter portion projecting towards said valve member, said spring abutting with one end against said adjusting screw and at the other end against a spring guide carrying said valve member, the free end of said reduced diameter portion forming an abutment for limiting movement of said spring guide away from the valve seat, said adjusting screw projecting with its other end beyond said tubular screw, and including a cap nut screwed on said projecting end of said adjusting screw.

17. An electrohydraulic control arrangement as defined in claim 15, wherein the other of said auxiliary valve means of said terminal plate comprises at one end of its tubular screw a mushroom-shaped spring carrier provided with openings therethrough and forming an abutment for limiting movement of its valve member away from its valve seat.

18. An electrohydraulic control arrangement as defined in claim 17, wherein said mushroom-shaped spring carrier is received in a radially enlarged portion of said tubular screw and held therein by an annular inwardly bent end portion of the latter.

19. An electrohydraulic control arrangement as defined in claim 17, wherein said other auxiliary valve means includes an actuating pin guided for movement in axial direction in said valve seat for moving said valve member away from said valve seat.

20. An electrohydraulic control arrangement as defined in claim 19, wherein the maximum stroke of said actuating pin is dimensioned so that the valve member when moved by said maximum stroke of said actuating pin away from the valve seat is spaced a small distance from said abutment.

21. An electrohydraulic control arrangement as defined in claim 11 or 20 wherein said tubular screw has an edge sealingly pressed against a sealing face of the respective plate and wherein said edge is of greater hardness than said sealing face.

22. A control arrangement as defined in claim 6, wherein a pair of compartments are formed at opposite ends of said control slide means in each of said consumer plates and including a pair of one-way valves movable between an open and a closed position for connecting in said open position said compartments respectively with those fluid channels which communicate with said outlet port, wherein said auxiliary valve means in said terminal plate and said pair of one-way valves in each consumer plate are of identical construction, and including electromagnets respectively cooperating with said one-way valves for moving the same between the positions thereof.

23. A control arrangement as defined in claim 22, and including at least one diode between the electrical connection of each electromagnet cooperating with said one-way valves in said consumer plates and the electrical connection of the electromagnets communicating with said reversing valves in said terminal plate.

24. An electrohydraulic control arrangement as defined in claim 1, wherein one of said closure screws is formed with an opening therethrough and constituting said inlet port.

25. A control arrangement as defined in claim 1, wherein each consumer plate is provided with two consumer ports and with three annular channels surrounding said bore, one of said annular channels communicating with said source and the other two annular channels respectively leading from said bore to said consumer ports, said control slide means being movable from a neutral position preventing flow of pressure fluid from said one annular channel to either of said other two annular channels to a pair of working positions connecting one or the other of said other two annular channels with said one annular channel, a pair of opposite one-way valves respectively arranged in said other two channels, each including a valve member, spring means biasing said valve member to a closed position and an actuator pin for moving the valve member against the force of said spring means to the open position, a transverse passage connecting said other two channels in the region between said opposite one-way valves, and a control piston in said transverse passage and cooperating with said actuating pin for opening the one-way valve in one of said two annular channels when said control slide means connects the other of said two channels with said one annular channel.

26. A control arrangement as defined in claim 25, wherein a pair of compartments are formed between opposite end faces of said control slide means in each consumer plate and corresponding faces of said closures screws, and including a pair of throttles respectively connecting said compartments with the fluid channel communicating with said source, and an additional pair of one-way valves each movable between an open and closed position for connecting in said open position said compartments respectively with those fluid channels which communicate with said outlet port.

27. A control arrangement as defined in claim 26, wherein each of said additional one-way valves is biased by a spring to said closed position and including a pair of electromagnets respectively cooperating with said pair of additional one-way valves for moving, when energized, the latter to said open position.

28. A control arrangement as defined in claim 26, and including a pair of compression springs acting in opposite directions on said control slide means for biasing the latter to said neutral position.

29. A control arrangement as defined in claim 28, wherein said control slide means in each consumer plate is formed with a pair of axially spaced bores extending from opposite end faces of said control slide means into the latter, a pair of bushings respectively slidably arranged in said bores and having each at the end facing the respective compartment a flange radially projecting beyond the end face of the control slide means to engage in said neutral position of the latter a face portion defining the respective compartment adjacent the respective end face of the control slide means, said compression springs being respectively arranged in said bushings, said radial flanges respectively cooperating with said closure screws for limiting the movement of the control slide means away from said neutral position.

30. A control arrangement as defined in claim 26, wherein said control slide means in each of said consumer plates is provided midways between open ends thereof with an annular groove and transverse bores extending from said annular groove to said axial bore, said throttles being respectively arranged on opposite sides of said transverse bores, and including an annular sieve in said annular groove covering the outer ends of said transverse bores.

31. A control arrangement as defined in claim 30, wherein said one annular channel is located in said plane of symmetry and said two other annular channels are arranged symmetrically with respect to said plane of symmetry, and including two further annular channels about said bore arranged symmetrically with respect to said plane and respectively communicating with those fluid channels which are connected in said terminal plate with said outlet port, said control slide means in said consumer plates being provided at the outer surface thereof with two further annular grooves arranged for providing in one of said working positions thereof communication between said one annular channel and one of said two other annular channels and in the other working position thereof communication between said one annular channel and the other of said two annular channels.

32. A control arrangement as defined in claim 31, wherein said pair of opposite one-way valves are arranged symmetrically with respect to the plane of symmetry in bores aligned with said transverse passage.

33. A control arrangement as defined in claim 32, wherein the valve member of each of said opposite one-way valves is constituted by a ball and wherein each of said opposite one-way valves includes axial guide faces for guiding said ball.

34. A control arrangement as defined in claim 33, wherein each of said opposite one-way valves comprises a carrier carrying said actuating pin movable in axial direction, each of said carriers being tightly arranged in the respective bore aligned with said transverse passage and having a harder sealing surface cooperating with a softer sealing edge provided in the respective bore.

35. A control arrangement as defined in claim 34, wherein said sealing surface forms part of a frustoconical connecting surface connecting said carrier with the peripheral surface of said one-way valve and including connecting channels between said connecting surface and a valve seat for said ball.

36. A control arrangement as defined in claim 34, wherein said carriers form abutments for limiting movement of said control piston.

37. A control arrangement as defined in claim 33, wherein said axial guide face for said balls is constituted by an axial bore and including radial slits leading from said axial bore to the peripheral surface of the respective one-way valve.

38. A control arrangement as defined in claim 32, and including additional closure screws closing said bores aligned with said transverse passage at the outer ends thereof, spring means biasing said valve members of said opposite auxiliary valves to said closed position and abutting with opposite ends thereof against the respective valve members and said additional closure screws, the latter limiting movement of said valve members in opening direction.

39. A control arrangement as defined in claim 31, wherein the edges of the two further annular grooves in said control slide means in each consumer plate are provided with bevelled portions.

40. An electrohydraulic control arrangement as defined in claim 1, wherein the control slide means in each of the consumer plates further includes a pair of throttles in said axial passage on opposite sides of said transverse passage.

41. An electrohydraulic control arrangement as defined in claim 40, wherein said throttle means are constituted by at least one additional transverse bore of small diameter in said control slide means of the terminal plate.

* * * * *